United States Patent [19]

Beckman

[11] 4,150,822

[45] Apr. 24, 1979

[54] BOWLING BALL ASSEMBLY

[76] Inventor: Robert P. Beckman, 705 E. Third St., Ottawa, Ohio 45875

[21] Appl. No.: 826,022

[22] Filed: Aug. 19, 1977

[51] Int. Cl.[2] ..... A63B 37/00

[52] U.S. Cl. ..... 273/63 B; 33/174 F; 273/63 E

[58] Field of Search ..... 273/63 R, 63 A, 63 B, 273/63 C, 63 D, 63 E, 63 F, 63 G; 33/174 F

[56] References Cited

U.S. PATENT DOCUMENTS

| | | | |
|---|---|---|---|
| 531,103 | 12/1894 | Dokkenwadel | 273/63 R |
| 1,026,069 | 5/1912 | Bendelari | 273/63 E |
| 2,566,511 | 9/1951 | Bassi | 273/63 B X |
| 2,693,034 | 11/1954 | Watson | 273/63 B |
| 3,383,109 | 5/1968 | Jankiewicz et al. | 273/63 B |
| 3,591,177 | 7/1971 | Skuse | 273/63 E |
| 3,861,681 | 1/1975 | Kelsey | 273/63 B |

*Primary Examiner*—George J. Marlo

*Attorney, Agent, or Firm*—Barker, Emch, Schaffer & Todd Co.

[57] ABSTRACT

A bowling ball assembly comprising a spherical major body portion having a larger and a smaller cavity for insertion of larger and smaller plugs, the larger plug having an off-center cavity for insertion of a third plug. A thumb hole is located in either the smaller plug or the third plug, and a pair of finger holes is located in the other of those two plugs. All plugs are rotatable to adjust the orientation of and span between the thumb and finger holes. All plugs are releasably secured by set screws which are accessible from the exterior of the assembly. The assembly can be bowled with and is useful for accurately fitting a bowler.

8 Claims, 7 Drawing Figures

BOWLING BALL ASSEMBLY

BACKGROUND OF THE INVENTION

To achieve a high degree of proficiency in the sport of bowling, it is essential that the ball properly and comfortably fits the hand of the individual bowler and that a ball weight be chosen which suits the strength and ability of that individual. Slight variations in the fit and weight can have a significant effect upon the consistency, accuracy, speed and degree of hook of the ball.

Presently, the most common means for selecting the fit involves the use of a spherical bowling ball assembly having two sections, rotatable relative to each other, each section including numerous holes for insertion of the thumb and bowling fingers. The bowler inserts each of his bowling fingers and thumb into the various holes until he selects ones which appear to have a proper degree of clearance, or from which the proper hole diameter may be estimated. Having done so, he then reinserts his thumb into the hole most closely approximating his size, and rotates the opposite section of the assembly until he locates two adjacent finger holes thereon most closely approximating a comfortable span for his hand. The selected ball is then drilled to those span and hole diameter specifications.

The above device, and other prior art devices, are limited in the choices of hole diameters and spans from which to determine the bowlers fit, and the bowler has no way of trying out the specified fit before his own personal ball is drilled. Also, the prior art methods do not provide means for selecting balls with a weight imbalance across any plane through the center of the ball. Such imbalances are desirable in altering the degree of hook and impact action of the ball. Thus, oftentimes, after the ball is drilled, a bowler is dissatisfied with the fit or the balance and their effect on his performance on the bowling lane.

SUMMARY OF THE INVENTION

The present invention is a bowling ball assembly used for precisely fitting the individual bowler, and with which the person may bowl before having his own personal ball drilled. The assembly includes a spherical major body portion having two cylindrical cavities within a span of each other, each cavity being symmetrical about an axis through the center of the assembly. Each cavity is designed to receive a cylindrical plug, one plug includes a hole for inserting the thumb and the other plug includes holes for inserting the bowling fingers. Since the plugs are removable, they can be replaced with another one of equal dimensions but having different thumb or finger hole diameters, respectively. Means are also provided for adjusting the span between the thumb and finger holes, and for adjusting the weight imbalance of the ball. Some bowlers desire that the finger or thumb holes be canted away from an axis through the center of the ball; plugs can be easily and cheaply manufactured to achieve such a cant, thereby allowing the person to try out various cants without having to purchase an entire ball. Thus, a bowler can try out an infinite number of hole diameters, spans, weight imbalances, and hole cants before selecting the most desired specifications to suit him individually.

It is, therefore, an object of the present invention to provide a bowling ball assembly for fitting the individual bowler.

It is also an object of the invention to provide a bowling ball asssembly for fitting the individual bowler, with which the person may bowl before having his own ball drilled.

It is further an object of the invention to provide a bowling ball assembly for fitting the individual bowler which has means for adjusting to an infinite number of combinations of hole diameters and spans.

Further objects will be obvious to those skilled in the art from the following description of a preferred embodiment.

DETAILED DESCRIPTION OF THE DRAWINGS

Figure 1:
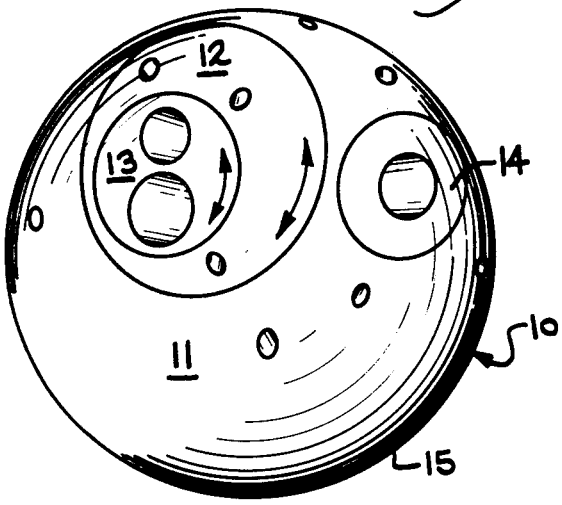
FIG. 1 is an overall perspective view of a bowling ball assembly in accordance with the present invention.

FIG. 1 illustrates an overall perspective view of a bowling ball assembly 10 in accordance with the present invention comprising a main spherical body 11, a cylinder 12, a cylindrical finger plug 13, and a cylindrical thumb plug 14. When completely put together, the assembly 10 forms a spherical surface 15 and is capable of functioning as a bowling ball. More detailed view and assembly of the above element are illustrated in FIGS. 2–6 and are discussed below.

The main body 11 has spherical exterior surface 20, a large cylindrical cavity 21, and a small cylindrical cavity 22. The cylinder 12 fits into the large cavity 21 and the thumb plug 14 fits into the small cavity 22. Also, the cylinder 12 includes a hole 23 into which fits the finger plug 13. It should be observed that the axes of the cavities 21 and 22, and the hole 23 (A, B, and D, respectively in FIG. 6), and thus, of the plug 14, cylinder 12, and finger plug 13, are directed through the center C of the assembly 10, and their boundaries are substantially symmetrical about their respective axes. Therefore, the thumb plug 14, cylinder 12, and finger plug 13 may be rotated in position about their respective axes without any loss of sphericity of the entire assembly 10. Although the respective cavities and plugs are described herein as being generally cylindrical, it should be clear that other geometric shapes, such as truncated cones, which are symmetrical about an axis through the center of the assembly may be used.

Figure 3:
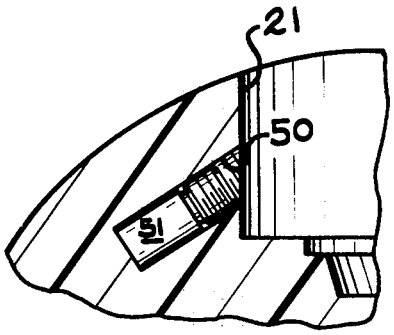
FIG. 3 is a sectional view along the line 3—3 in FIG. 2.

The thumb plug 14 comprises an exterior 25, a top 26, and a thumb hole 27. The exterior 25 is cylindrical with a radius approximating that of walls 28 of the small cylindrical cavity 22, such that the thumb plug 14 may snugly engage the small cavity 22 but is still rotatable therein. When the thumb plug 14 is properly in position, the top 25 coincides with the spherical surface 15 of the entire assembly 10. Generally, the axis E of the thumb hole 27 will coincide with that of the thumb plug 14 itself. However, it is not so limited since many bowlers prefer that the axis E of their thumb hole 27 be canted away from an axis through the center of the bowling ball, as shown in FIG. 3. By making the thumb plug 14 rotatable, the direction in which the thumb hole 27 is canted with respect to the finger plug 13 is adjustable. The thumb plug 14 is secured from rotational and radial movement relative to the main body 11 by means of set screws (not shown) threaded into set screw holes 29 extending from the spherical exterior surface 20 of the main body 11 into the small cavity 22.

The cylinder 12 comprises an exterior 30, a top surface 31 in the shape of a spherical segment, and a hole 23. The exterior 30 is cylindrical with a radius approximately that of walls 32 of the large cylindrical cavity 21, such that the cylinder 12 may snugly engage the large cavity 21 but is still rotatable therein. When the cylinder 12 is positioned in the cavity 21, it abuts a shoulder 33 at the bottom of the large cavity 21 and the top surface 31 defines a segment of the spherical surface 15 of the entire assembly 10.

The axis D of the hole 23, although directed through the center C of the assembly 10, is not coincident with the axis A of the cylinder 12. Therefore, when the cylinder 12 is rotated in position about its axis A, the distance between the hole 23 and the thumb hole 27 is changed. This allows for adjusting the span between the thumb hole 27 in the thumb plug 14 and the finger holes 34 in the finger plug 13. The cylinder 12 is secured from rotational and radial movement relative to the main body 11 by means of a plurality of set screws (not shown) threaded into set screw holes 35 extending from the exterior surface 20 of the main body 11 into the large cavity 21.

The finger plug 13 comprises an exterior 40, a top surface 41, and at least one and usually two finger holes 34. The exterior 40 is cylindrical with a radius approximately that of the walls 43 of the hole 23, such that the finger plug 13 may snugly engage the hole 23 but is still rotatable therein. When the finger plug is properly in position, it rests on the shoulder 44 at the bottom of the hole 23 and the top 41 coincides with the sphere 15 of the entire assembly. The axes of the finger holes 34, like the thumb hole 27, are not limited to any particular direction, such as parallel with the axis of the finger plug 13 which extends through the center of the assembly 10, and therefore any reasonable cant may be provided, if desired.

Since the orientation of the finger holes 34 with respect to the thumb hole 27 will change as the cylinder 12 is rotated about its axis A, the finger plug 13 is also rotatable. By rotating the finger plug 13, the two finger holes 34 can be oriented equidistant from the thumb hole 27 or at slightly different distances to compensate for different length fingers. The finger plug 13 is secured from rotation and radial movement relative to the cylinder 12 by means of set screws (not shown) threaded into holes 45 extending from the top surface 31 of the cylinder 12 into the hole 23.

Figure 2:
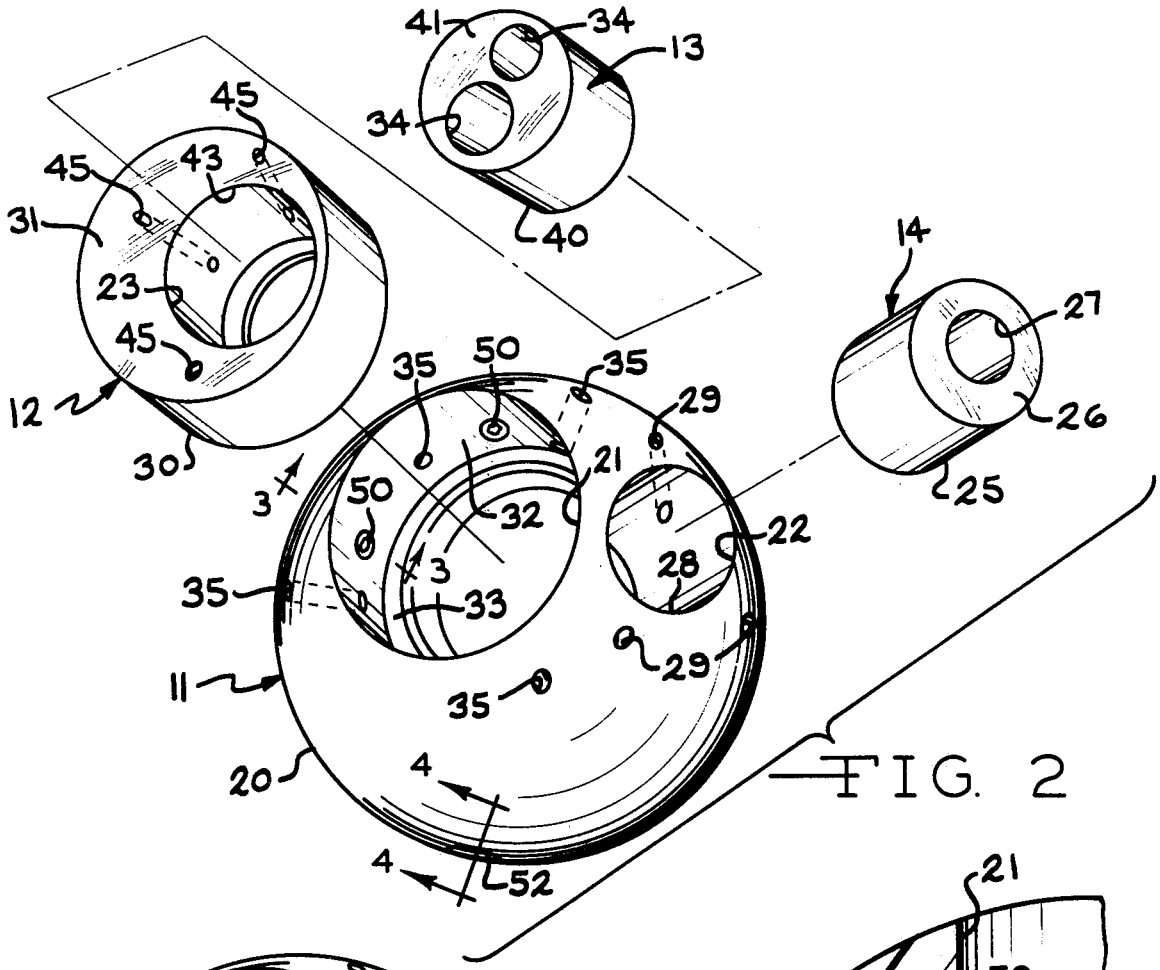
FIG. 2 is an exploded view of the bowling ball assembly in FIG. 1.
Figure 4:
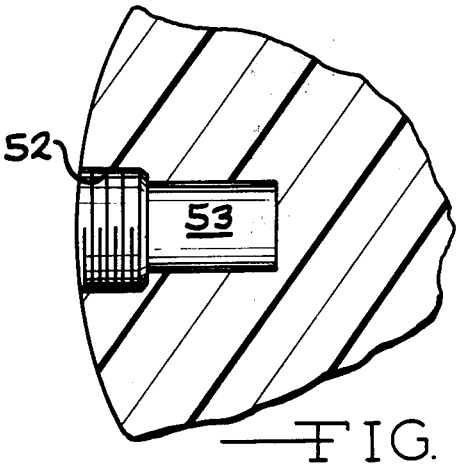
FIG. 4 is a sectional view along the line 4—4 in FIG. 2.
Figure 5:
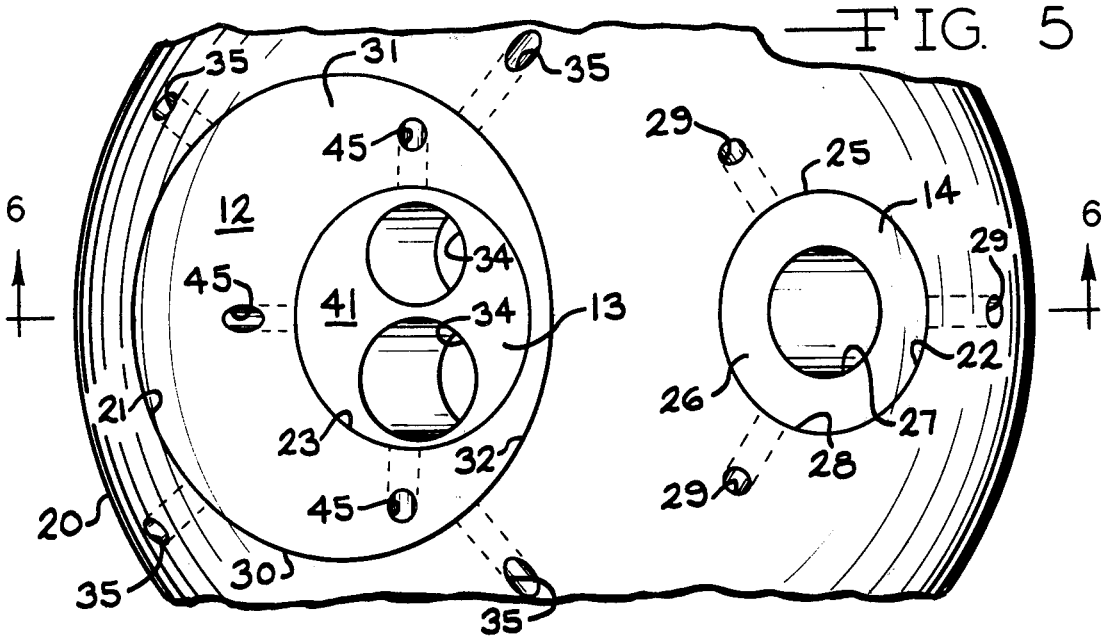
FIG. 5 is a fragmentary view of the bowling ball assembly in FIG. 1 showing the finger and thumb components.
Figure 6:
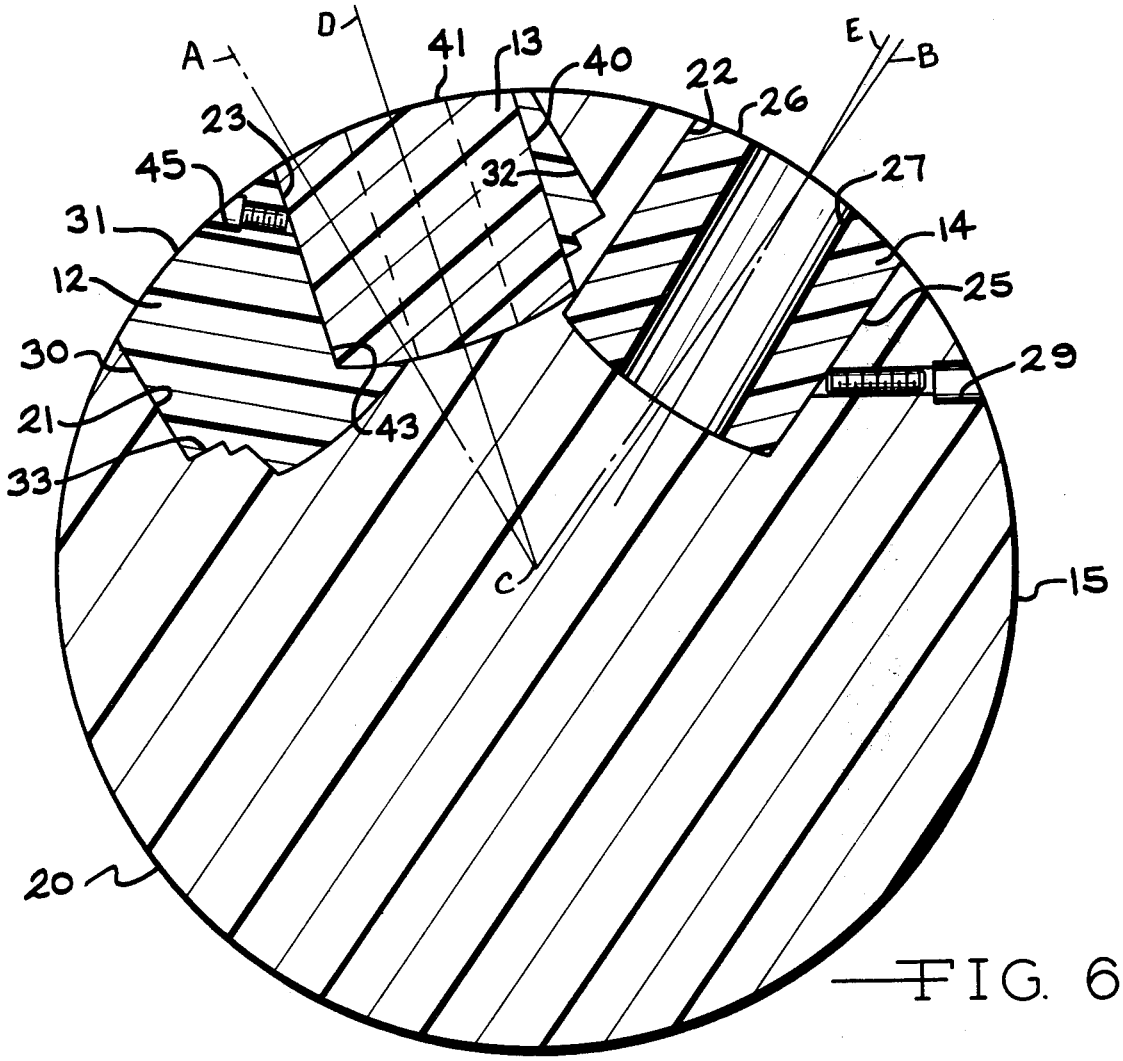
FIG. 6 is a sectional view along the line 6—6 in FIG. 5.

As shown in FIGS. 2 and 3, holes 50 are spaced around the walls 32 of the large cylindrical cavity 21 for selectively receiving weights 51 for controlling the balance of the assembly 10. The holes 50 can be threaded in part for engaging mating threads on the weights 51 and securing them in position. The weights 51 are preferably made from lead, although any solid material with a density greater than the density of the bulk of the assembly 10 may be used. Similar threaded holes 52 are provided around the exterior surface 20 of the main body 11 for inserting weights 53, as shown in FIGS. 2 and 4. The purpose for the weights 51, 53 is to create a weight imbalance across any desired plane through the center C of the assembly 10. Such weight imbalance is desired by many bowlers to impart a greater hook or curve to the ball, and to achieve a more powerful impact. To this end, the bowler can experiment with different size weights 51, 53 and with different locations for the center of gravity of the assembly 10 to achieve his best game.

The above preferred embodiment of the bowling ball assembly having been described in detail, its uses and advantages should be quite apparent. For example, the bowler may try out different thumb and finger holes sizes and cants by simply changing the thumb and finger plugs. A number of thumb and finger plugs could be manufactured for such purpose, providing a broad selection to the bowler. Furthermore, once having selected the desired hole sizes and cants, the span between the thumb and finger holes may be changed by simply rotating the large cylinder 12, and the finger hole orientation may be changed by rotating the finger plug 13. In addition, the weight imbalance may be easily modified as set forth above. The assembly may then be used as a bowling ball for experimental purposes without having to drill a new ball each time a change is desired. In this way, the bowler may accurately select bowling ball specifications which suit him individually.

Figure 7:
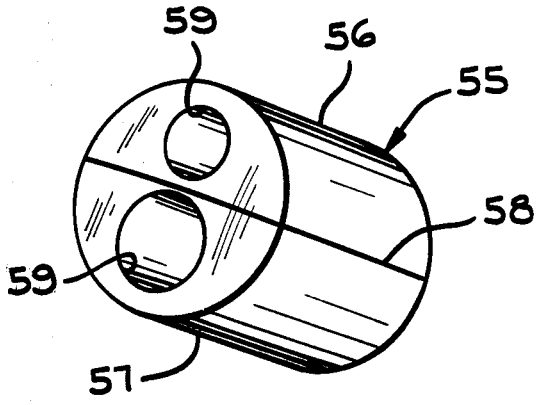
FIG. 7 is a perspective view of a modification of the finger plug used in the bowling ball assembly.

It should also be apparent that several modifications can be made to the above-described assembly without departing from the scope of the invention. For example, the finger plug 55 could be manufactured in two sections, 56 and 57 divided along a plane substantially parallel to the axis of the finger plug 55, as shown by the line 58 in FIG. 7, having one hole 59 through each section, 56 and 57. Each section could then be changed separately, allowing for a greater number of finger hole diameters, spacings and cant variations, but using less material. It should be understood that the term "parallel" used in the above context includes a plane which is coincident with the axis of the finger plug.

Also, the assembly could be manufactured with the finger and thumb plugs in switched positions. In that case, since the thumb plug has only one hole approximately through the center, it would not need to be rotatable within the larger cylinder hole. The finger plug would, of course, need to remain rotatable to adjust the orientation of the finger holes relative to the thumb hole. Since, in this embodiment, the thumb plug does not need to be rotatable, it can be eliminated and a replaceable large cylinder with an off-center thumb hole can be used instead. However, such an embodiment does not allow for canting the thumb hole with respect to a radial through the ball assembly since rotating the single large cylinder will change the direction of any cant in the thumb hole with respect to the finger holes.

What I claim is:

1. A bowling ball assembly having a substantially spherical outer surface comprising a spherical major body portion having a smaller cavity and a larger cavity, said smaller and larger cavities extending symmetrically about angularly displaced axes radiating from the center of said assembly, the arc between said smaller and larger cavities being less than the distance between the end of a thumb and the end of any finger on a hand of a user of said ball assembly, a first plug rotatably fitting into said smaller cavity, a second plug rotatably fitting into said larger cavity, said second plug having a cavity extending symmetrically about an axis radiating from the center of said assembly, a third plug rotatably fitting into said second plug cavity, said first and second and third plugs having rounded outermost surfaces coinciding with and forming segments of said assembly spherical outer surface, one of said first and third plugs including a centrally located opening at said outer surface leading to a substantially cylindrical hole for receiving a thumb from a hand and the other of said first and third plugs including two substantially cylindrical holes for receiving fingers from such hand, the axis of said second plug cavity being non-coincident with said axis of said larger cavity whereby rotation of said second plug increases the span between said thumb hole and said finger holes, at least one threaded hole extending from said assembly outer surface to the sidewall of said larger cavity, at least one threaded hole extending from said assembly outer surface to the sidewall of said smaller cavity, at least one threaded hole extending from said second plug rounded outer-most surface to the sidewall of said second plug cavity, set screws within said holes which are completely accessible from said assembly outer surface whereby each of said plugs may be releasably secured from rotational and radial movement relative to said major body portion and whereby each of said plugs may be removed from said assembly by releasing engagement of said set screws.

2. A bowling ball assembly, as defined in claim 1, wherein said first plug includes said thumb hole and said third plug includes said finger holes.

3. A bowling ball assembly, as defined in claim 3, wherein said third plug comprises two sections, each of said sections including one of said finger holes.

4. A bowling ball assembly, as defined in claim 2, including means for creating a predetermined weight imbalance along any plane through the center of said assembly.

5. A bowling ball assembly, as defined in claim 4, wherein said weight imbalance means includes a plurality of compartments extending into said major body portion from said larger cavity sidewall and weight means formed from a material with a greater density that the rest of said assembly for selective insertion into said compartments.

6. A bowling ball assembly, as defined in claim 4, wherein said weight imbalance means includes a plurality of compartments extending into said major body portion from said assembly outer surface and weight means formed from a material with a greater density than the rest of said assembly for selective insertion into said compartments.

7. A bowling ball assembly, as defined in claim 1, wherein the axes of said thumb and finger holes are canted away from axes radiating from the center of said assembly and whereby the direction of cant of said thumb and finger holes may varied by rotating said plugs.

8. A bowling ball assembly having a substantially spherical outer surface comprising a spherical major body portion having a smaller cavity and a larger cavity, said smaller and larger cavities extending symmetrically about angularly displaced axes radiating from the center of said assembly, the arc between said smaller and larger cavities being less than the distance between the end of a thumb and the end of any finger on a hand of a user of said ball assembly, a first plug rotatably fitting into said smaller cavity, a second plug rotatably fitting into said larger cavity, said second plug having a cavity extending symmetrically about an axis radiating from the center of said assembly, a third plug rotatably fitting into said second plug cavity, said first and second and third plugs having rounded outermost surfaces coinciding with and forming segments of said assembly spherical outer surface, said first plug including a substantially cylindrical hole for receiving a thumb from a hand and said third plug including two substantially cylindrical holes for receiving fingers from such hand, the axis of said second plug cavity being non-coincident with said axis of said larger cavity whereby rotation of said second plug increases the span between said thumb hole and said finger holes, at least one threaded hole extending from said assembly outer surface to the sidewall of said larger cavity, at least one threaded hole extending from said assembly outer surface to the sidewall of said smaller cavity, at least one threaded hole extending from said second plug rounded outermost surface to the sidewall of said second plug cavity, set screws within said holes which are completely accessible from said assembly outer surface whereby each of said plugs may be releasably secured from rotational and radial movement relative to said major body portion and whereby each of said plugs may be removed from said assembly by releasing engagement of said set screws, and a means for creating a predetermined weight imbalance along any plane through the center of said assembly, said weight imbalance means comprising a plurality of threaded compartments extending into said major body portion from said larger cavity sidewall and from said assembly outer surface and threaded weight means for selective engagement into said compartments.

* * * * *

UNITED STATES PATENT OFFICE

CERTIFICATE OF CORRECTION

Patent No. 4,150,822 Dated April 24, 1979

Inventor(s) Robert P. Beckman

It is certified that error appears in the above-identified patent and that said Letters Patent are hereby corrected as shown below:

Column 4, line 37, after "section" insert -- , 56 and 57, --.

Column 5, line 34, change "3" to -- 2 --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*